US006994427B2

(12) United States Patent
Oishi

(10) Patent No.: US 6,994,427 B2
(45) Date of Patent: Feb. 7, 2006

(54) INK JET RECORDING HEAD

(75) Inventor: Tatsuo Oishi, Aichi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 215 days.

(21) Appl. No.: 10/702,587

(22) Filed: Nov. 7, 2003

(65) Prior Publication Data

US 2004/0095438 A1 May 20, 2004

(30) Foreign Application Priority Data

Nov. 8, 2002 (JP) ..... 2002-325542

(51) Int. Cl.
*B41J 2/045* (2006.01)

(52) U.S. Cl. ..... 347/68; 347/71

(58) Field of Classification Search ..... 347/40, 347/42, 47, 68–72

See application file for complete search history.

(56) References Cited

U.S. PATENT DOCUMENTS

| | | | | |
|---|---|---|---|---|
| 5,406,318 | A * | 4/1995 | Moore et al. | 347/70 |
| 5,455,615 | A * | 10/1995 | Burr et al. | 347/92 |
| 5,757,400 | A | 5/1998 | Hoisington | |
| 5,767,873 | A * | 6/1998 | Rogers et al. | 347/40 |
| 6,220,698 | B1 * | 4/2001 | Katakura | 347/68 |
| 6,488,355 | B2 * | 12/2002 | Nakamura et al. | 347/40 |
| 2002/0075361 | A1 | 6/2002 | Kanda et al. | |
| 2002/0080215 | A1 | 6/2002 | Sakaida et al. | |

FOREIGN PATENT DOCUMENTS

| | | |
|---|---|---|
| JP | A 9-314839 | 12/1997 |
| JP | A 11-277743 | 10/1999 |
| JP | A 2000-334946 | 12/2000 |
| JP | A 2001-334661 | 12/2001 |
| JP | A 2002-166543 | 6/2002 |

* cited by examiner

*Primary Examiner*—Manish S. Shah
*Assistant Examiner*—Geoffrey S. Mruk
(74) *Attorney, Agent, or Firm*—Oliff & Berridge, PLC

(57) ABSTRACT

The angles and sizes for each of the constituent members of the ink jet recording head is designed to satisfy the following relational expression:

$$K0 \cdot N^{a0} \cdot A^{b0} \cdot \alpha^{c0} \cdot Spin^{d0} \cdot (Scav/Spin)^{e0} \cdot (Spzt/Scav)^{f0} \leqq 0.$$

in which a0=1.87686, b0=0.31786, c0=−0.18649, d0=−1.09273, e0=3.97019, f0=0.93332 and K0=0.05307 are satisfied when N is a number of layers in one of a piezoelectric element, A is a number of active layers in the piezoelectric element, α is an angle [°] which is one of internal angles of virtual lattices containing one of a cavity and forming a matrix and which is not higher than 90°, Spin is an area [$mm^2$] occupied by one lattice in the matrix, Scav is an area [$mm^2$] occupied by the cavity contained in one lattice in the matrix, and Spzt is an area [$mm^2$] occupied by an active portion of the piezoelectric element provided in accordance with one lattice in the matrix.

12 Claims, 11 Drawing Sheets

INK JET RECORDING HEAD

BACKGROUND OF THE INVENTION

1. Field of the Invention

The present invention relates to an ink jet recording head for discharging ink onto a recording medium and particularly to an ink jet recording head provided with cavities, which holds the ink, arranged as a matrix.

2. Description of the Related Art

An ink jet recording head (hereinafter also referred to simply as an ink jet head) is formed so that ink supplied from an ink tank to manifolds is allocated to a plurality of pressure chambers so that ink is discharged from a nozzle hole corresponding to selected one of the pressure chambers when pressure is applied to the selected pressure chamber. The pitch of arrangement of nozzles needs to be narrowed to meet a demand for high image quality and for high resolution on the ink jet head.

In the ink jet head, other constituent members than the nozzles such as piezoelectric elements and cavities need to be arranged densely according to the reduction of the pitch. In the ink jet head in which the constituent members are densely arranged, when pressure is applied to one pressure chamber to discharge an ink drop, the applied pressure is however transmitted to adjacent pressure chambers to bring a problem of crosstalk having influence on discharge characteristic of the adjacent pressure chambers.

In order to solve the problem above, there has been proposed, in JP-A-2000-334946, an ink jet head provided with diaphragms each of which forms at least one surface of a liquid chamber communicating with a nozzle, wherein each diaphragm is made of a laminate of a resin film and an SUS (Steel Use Stainless) material so that the thickness T of the resin film is substantially selected to satisfy $0.035*W<T<0.065*W$ with respect to the width W of the liquid chamber in the lateral direction to thereby attain reduction in crosstalk.

Although the related art may be used effectively in an ink jet head having nozzles arranged in a single row, there is doubt whether the related art can be used effectively in an ink jet head having cavities (pressure chambers) arranged as a matrix to achieve higher-density arrangement of nozzles. This is because there is the possibility that the influence of crosstalk on image quality may become larger in the ink jet head having cavities arranged as a matrix due to crosstalk received by an objective cavity not only from cavities adjacent to the objective cavity in one direction but also from cavities surrounding the objective cavity.

SUMMARY OF THE INVENTION

The present invention is developed to solve the above described problem and an object of the invention is to provide an ink jet head having cavities arranged as a matrix, in which crosstalk from adjacent cavities is reduced to obtain such good image quality that mispositioning of pixels (dots) cannot be recognized by human eyes.

In order to achieve the object, according to a first aspect of the invention, there is provided an ink jet recording head for discharging ink drop onto a recording medium, including: a plurality of cavities configured to hold ink; a plurality of piezoelectric elements disposed on the cavities respectively and configured to press each of the cavities; and a plurality of ink discharge orifices arranged on a ink discharging surface as a matrix and each connected to the cavities respectively, wherein the ink jet recording head is designed to satisfy the following relational expression:

$$K0\cdot N^{a0}\cdot A^{b0}\cdot \alpha^{c0}\cdot Spin^{d0}\cdot (Scav/Spin)^{e0}\cdot (Spzt/Scav)^{f0} \leq 0.1$$

where a0=1.87686, b0=0.31786, c0=−0.18649, d0=−1.09273, e0=3.97019, f0=0.93332 and K0=0.05307 are satisfied when N is a number of layers in one of the piezoelectric element, A is a number of active layers in one of the piezoelectric element, α is an angle [°] which is one of internal angles of virtual lattices containing one of the cavity and forming the matrix and which is not higher than 90°, Spin is an area [$mm^2$] occupied by one lattice in the matrix, Scav is an area [$mm^2$] occupied by the cavity contained in one lattice in the matrix, and Spzt is an area [$mm^2$] occupied by an active portion of the piezoelectric element provided in accordance with one lattice in the matrix.

In order to achieve the object, according to a second aspect of the invention, there is provided an ink jet recording head for discharging ink drop onto a recording medium, including: a plurality of cavities configured to hold ink; a plurality of piezoelectric elements disposed on the cavities respectively and configured to press each of the cavities; and a plurality of ink discharge orifices arranged on a ink discharging surface as a matrix and each connected to the cavities respectively, wherein the ink jet recording head is designed to satisfy the following relational expression:

$$K0'\cdot N^{a0'}\cdot A^{b0'}\cdot \alpha^{c0'}\cdot Spin^{d0'}\cdot (Scav/Spin)^{e0'}\cdot (Spzt/Scav)^{f0'} \leq 0.1$$

where a0'=1.55486, b0'=0.27907, c0'=1.03986, d0'=−0.97015, e0'=4.24397, f0'=1.03880 and K0'=0.00013 are satisfied when N is a number of layers in one of the piezoelectric element, A is a number of active layers in one of the piezoelectric element, α is an angle [°] which is one of internal angles of virtual lattices containing one of the cavity and forming the matrix and which is not higher than 90°, Spin is an area [$mm^2$] occupied by one lattice in the matrix, Scav is an area [$mm^2$] occupied by the cavity contained in one lattice in the matrix, and Spzt is an area [$mm^2$] occupied by an active portion of the piezoelectric element provided in accordance with one lattice in the matrix.

BRIEF DESCRIPTION OF THE DRAWINGS

These and other objects and advantages of the present invention will become more fully apparent from the following detailed description taken with the accompanying drawings, in which.

DETAILED DESCRIPTION OF THE PREFERRED EMBODIMENTS

Figure 1:
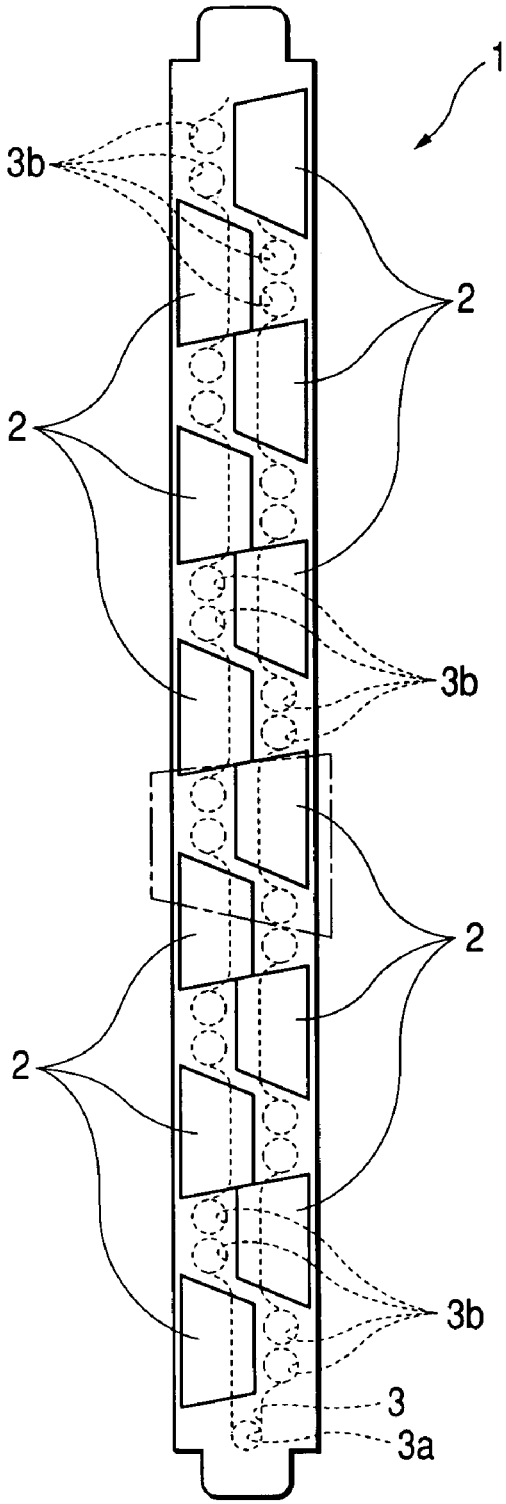
FIG. 1 is a bottom view of an ink jet head according to an embodiment of the invention.
Figure 2:
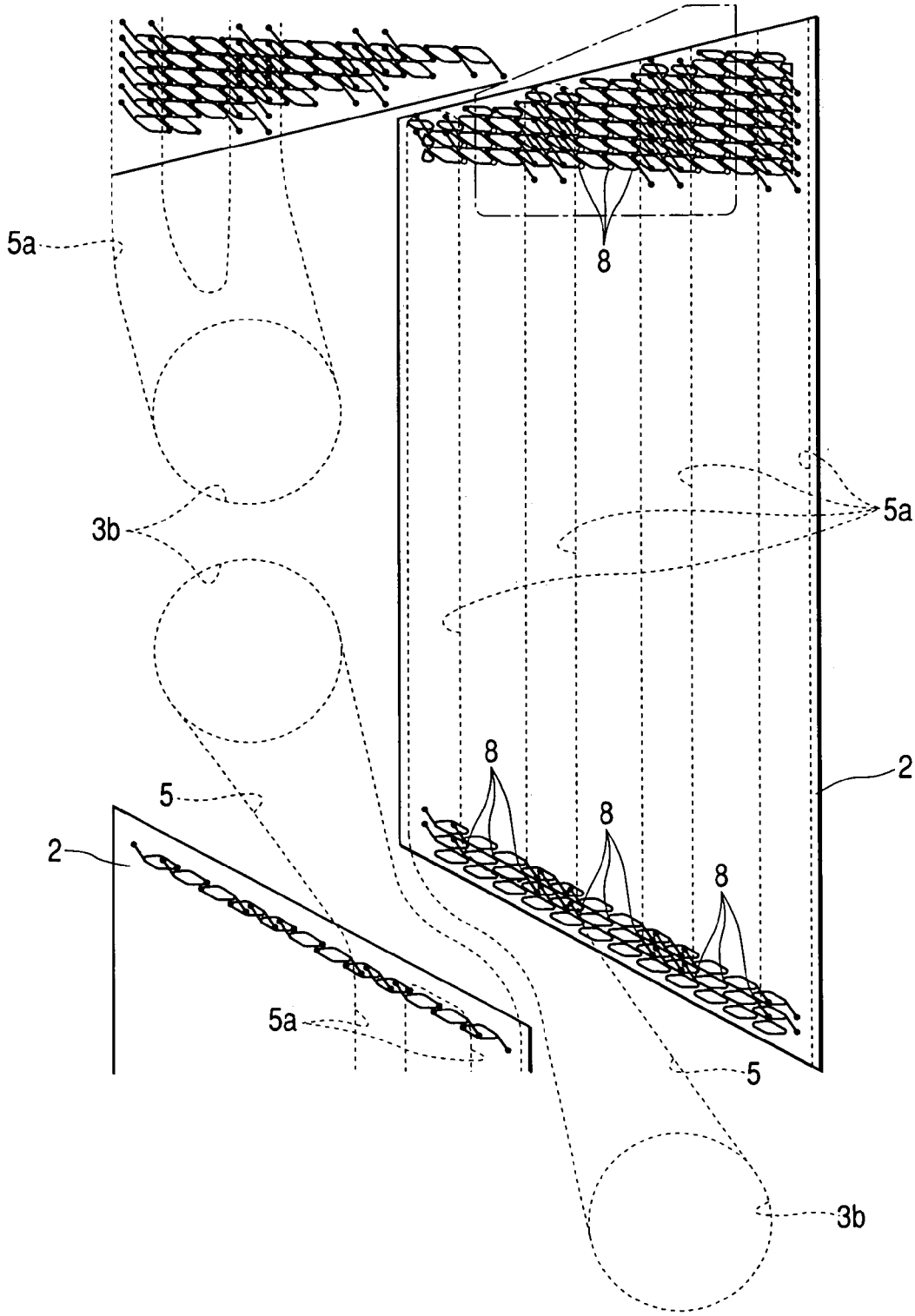
FIG. 2 is an enlarged view of a region enclosed with chain lines drawn in FIG. 1.
Figure 3:
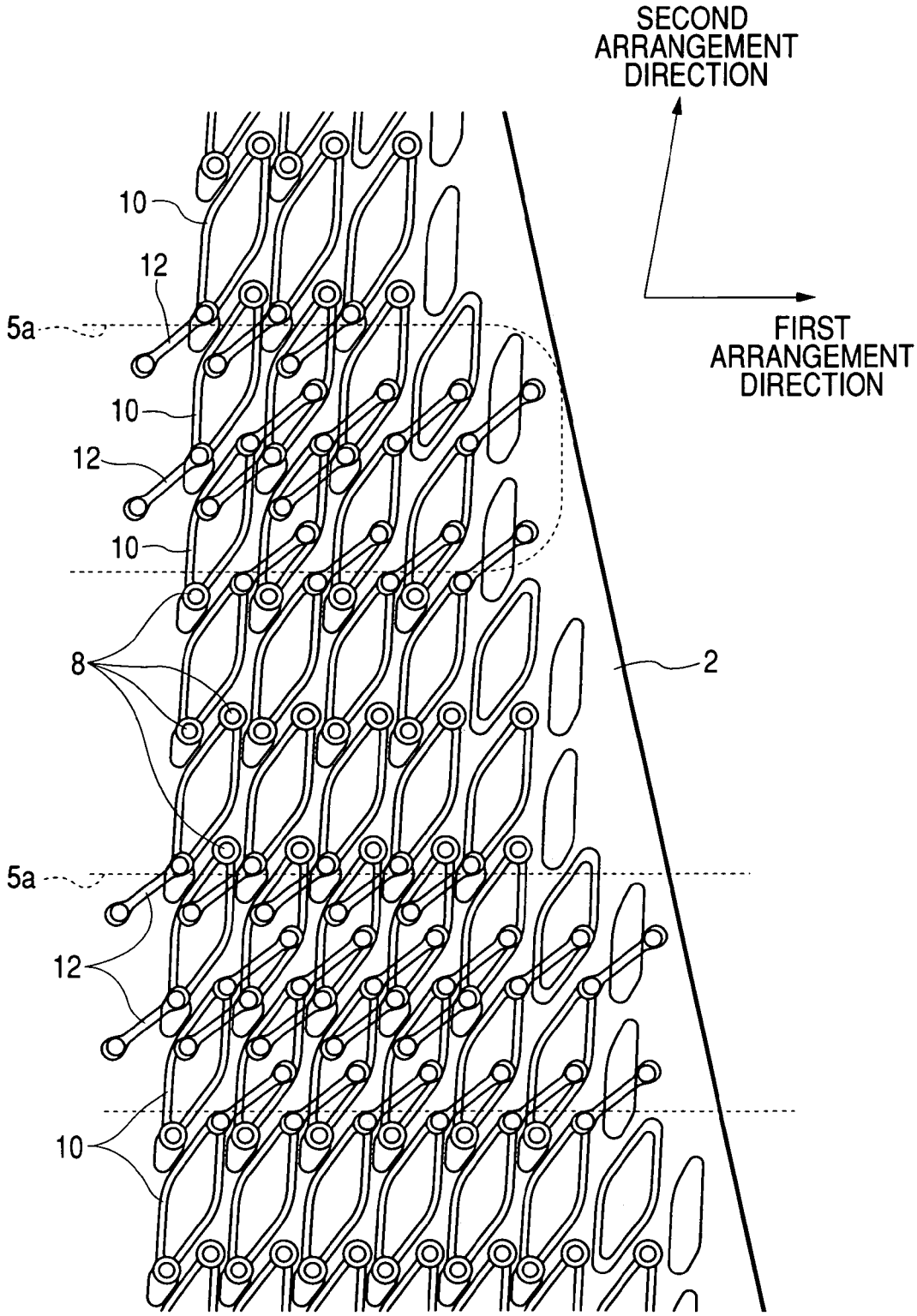
FIG. 3 is an enlarged view of a region enclosed with chain lines drawn in FIG. 2.
Figure 4:
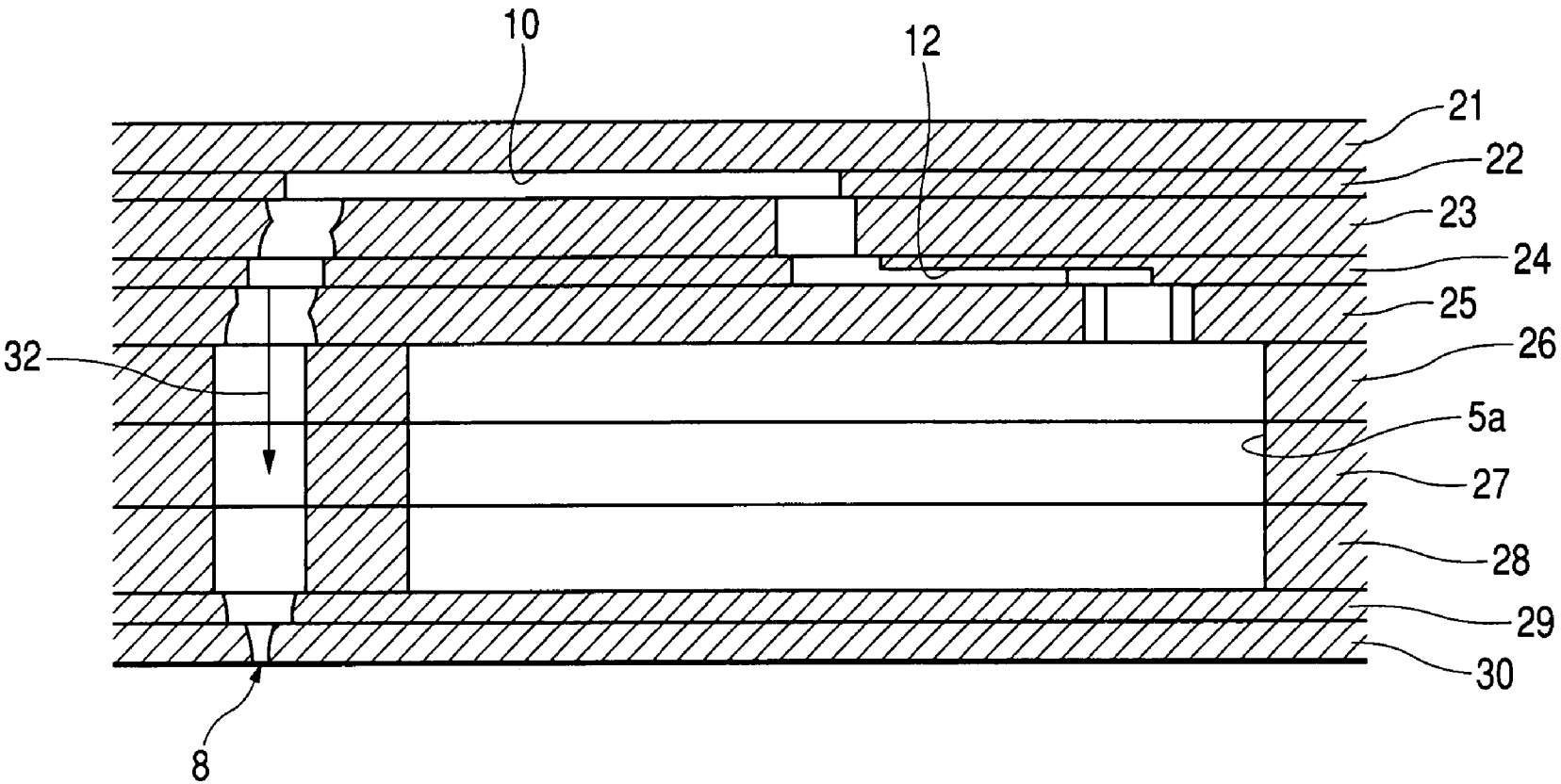
FIG. 4 is a sectional view of important part of the ink jet head depicted in FIG. 1.

Referring now to the accompanying drawings, a description will be given in detail of preferred embodiments of the invention. Hereinafter, an ink jet recording head (ink jet head) 1 according to an embodiment of the invention will be described with reference to FIGS. 1 through 4. FIG. 1 is a bottom view of the ink jet head 1. FIG. 2 is an enlarged view of a region enclosed with chain lines drawn in FIG. 1. FIG. 3 is an enlarged view of a region enclosed with chain lines drawn in FIG. 2. FIG. 4 is a sectional view of important part of the ink jet head 1 depicted in FIG. 1.

The ink jet head 1 differs from such a conventional ink jet head in which to be opposed to a recording medium and moved in a scanning direction, or a conventional ink jet head that a plurality of nozzles are arranged in a single line or in a few lines and being used for a so-called line printer. The ink jet head 1 has a plurality of nozzles arranged as a matrix on a surface of ink discharge region. The ink jet head 1 is used in a fixed state and not being moved in a scanning direction, and has an ability to discharge a ink drop from each of the plurality of the nozzles onto the recording medium that moves in a significantly high speed against the ink jet head 1, to thereby record (print) an image on the recording medium in high quality and resolution in a significantly high speed.

Hereinafter, a description will be made by defining a direction of passing through the recording medium against the ink jet head 1 as a secondary scanning direction, and by defining a direction orthogonal to the secondary scanning direction as a main scanning direction.

As shown in FIG. 1, the ink jet head 1 according to the embodiment is shaped like a rectangle extending in one direction (the main scanning direction). A large number of trapezoidal ink discharge regions 2 arranged in staggered (zigzag) manner in two rows are provided in a bottom of the ink jet head 1. In other words, each of the ink discharge regions 2 are arranged in a position displaced (shifted) in a predetermined displacement length from the adjacent ink discharge region 2.

As will be described later, a large number of ink discharge orifices 8 (see FIGS. 2 and 3) are arranged in surfaces of each ink discharge region 2. An ink reservoir 3 is formed in the inside of the ink jet head 1 so as to extend along the lengthwise direction of the ink jet head 1. The ink reservoir 3 communicates with an ink tank (not shown) through an opening 3*a* provided at an end of the ink reservoir 3, so that the ink reservoir 3 is filled with ink when the ink jet head 1 is in use. The ink reservoir 3 further has openings 3*b* which are provided in pairs along the extending direction of the ink reservoir 3 so as to be arranged in staggered (zigzag) manner in other regions than the ink discharge regions 2.

As shown in FIGS. 1 and 2, the ink reservoir 3 communicates with manifolds 5 as lower layers of the openings 3*b* through the openings 3*b*. Filters for catching extraneous substance such as dust contained in ink may be provided in the openings 3*b*. Each manifold 5 forks into two sub-manifolds 5*a* at its front end portion. Every two sub-manifolds 5*a* enter an upper portion of one ink discharge region 2 through two openings 3*b* adjacent to the ink discharge region 2 with respect to the lengthwise direction of the ink jet head 1. That is, in one ink discharge region 2, four sub-manifolds 5*a* in total extend along the lengthwise direction of the ink jet head 1. Each sub-manifold 5*a* is filled with ink provided from the ink reservoir 3.

As shown in FIGS. 2 and 3, a large number of ink discharge orifices 8 are arranged in surfaces of each ink discharge region 2. As is also obvious from FIG. 4, each ink discharge orifice 8 forms a tapered nozzle and communicates with a sub-manifold 5*a* through a pressure chamber (cavity) 10 substantially rhombic in plan view and an aperture 12.

In the ink jet head 1, as structured as described above, flow paths are formed, the flow paths that leading from the ink tank to the pressure chambers 10 via the ink reservoir 3, the manifolds 5, the sub-manifolds 5*a* and the apertures 12 and further leading to the ink discharge orifices 8 through ink flow paths 32. The center axis of the ink flow path 32 extends to the inside of the ink jet head 1 so as to perpendicularly cross a plane containing the pressure chamber 10.

Incidentally, the pressure chambers 10 and the apertures 12 are disposed in the inside of the ink discharge regions 2 and not be apparent from the ink discharge surface. However, in FIGS. 2 and 3, the pressure chambers 10 and the apertures 12 to be drawn as broken lines are drawn as solid lines in FIGS. 2 and 3 for the sake of facilitating understanding of the drawings.

As is also obvious from FIG. 3, in each ink discharge region 2, the pressure chambers 10 are arranged so as to adhere one another in such a manner that the aperture 12 communicating with one pressure chamber 10 overlaps a pressure chamber 10 adjacent to the pressure chamber. A factor making this arrangement possible is in that the ink jet head 1 is formed as a laminated structure having a plurality of plate materials 21 to 30 as also shown in FIG. 4 so that each pressure chamber 10 and a corresponding aperture 12 are provided on different levels.

Hereinafter, the laminated structure in the ink jet head 1 will be described. As shown in FIG. 4, the ink jet head 1 includes: an actuator unit 21 shaped like a trapezoid as a whole and having built-in piezoelectric elements corresponding to the pressure chambers 10; a cavity plate 22 having through-holes formed as the pressure chambers 10; a base plate 23 having communication holes provided in accordance with opposite end portions of each pressure chamber 10; and an aperture plate 24 having communication holes connected to the communication holes of the baseplate 23, and apertures 12. The inkjet head 1 further includes: a supply plate 25 forming wall portions of the sub-manifolds 5*a* and having communication holes connected to the communication holes of the aperture plate 24 to thereby form part of the ink flow paths 32, and communication holes for connecting one end of each aperture 12 to a corresponding sub-manifold 5*a;* three manifold plates 26, 27 and 28 having through-holes for forming the sub-manifolds 5*a,* and nearly circular through-holes for forming the ink flow paths 32; a cover plate 29 forming other wall portions of the sub-manifolds 5*a* and having through-holes formed for connecting the ink flow paths 32 to the nozzles (ink discharge orifices) 8; and a nozzle plate 30 having the nozzles 8 formed therein.

The pressure chambers 10 are arranged as a matrix in the form of a closest packed structure. In each pressure chamber 10, the ink flow path 32 extends to the nozzle (ink discharge orifice) 8 while the ink flow path 32 is displaced along the direction of ink flowing in the pressure chamber 10.

The sub-manifolds 5*a* are provided in the inside of the ink jet head 1 so as to extend along rows constituted by the pressure chambers 10 arranged as a matrix in the lengthwise direction of the ink jet head 1. The pressure chambers 10 in a row adjacent to each sub-manifold 5*a* are located so as to overlap part of the sub-manifold 5*a* when viewed in the direction of the thickness (depth) of the ink jet head 1.

As described above, constituent members such as the cavity 10 and apertures 12 of the ink jet head 1 are arranged three-dimensionally densely so that the pressure chambers 10 can be arranged densely to achieve the formation of a high-resolution image by the ink jet head 1 occupied in a relatively small space.

In a plane drawn in FIGS. 2 and 3, the pressure chambers 10 are arranged in each ink discharge region 2 in two directions composed of the lengthwise direction of the ink jet head 1 (the main direction; also referred to as a first arrangement direction), and a direction (referred to as a second arrangement direction) slightly inclined to the widthwise direction (the secondary direction) of the ink jet head 1. The ink discharge orifices 8 are arranged at intervals of 37.5 dpi (That is, 37.5 pieces of the ink discharge orifices 8 in one inch.) in the first arrangement direction. In the embodiment, when seen from the second arrangement direction (in which almost equals to the secondary direction), 16 rows of nozzle lines, which each formed by the arrangement of the ink discharge orifices 8, are formed. In other words, the pressure chambers 10 are arranged so that 16 pressure chambers 10 at the most are contained in two ink discharge regions 2 in the second arrangement direction. The displacement in the first arrangement direction due to the arrangement of 16 pressure chambers 10 in the second arrangement direction is equivalent to a width of one pressure chamber 10. Accordingly, the ink jet head 1 is configured to have 16 ink discharge orifices 8 within a range of the distance between the two ink discharge orifices 8 that adjacent each other in the first arrangement direction, and in the whole width, which corresponds to the length of the ink jet head 1 in the secondary scanning direction. Incidentally, at opposite end portions of each ink discharge region 2 in the first arrangement direction, the ink discharge region 2 becomes complementary to an ink discharge region 2 facing the ink discharge region 2 in the widthwise direction of the ink jet head 1 to thereby satisfy the aforementioned configuration.

When printing on a recording medium by using the ink jet head 1 structured as described above, the recording medium opposed to the ink jet head 1 is passed through in a high speed, and the ink jet head 1 discharges a plurality of ink drops from the plurality of the ink discharge orifices 8 arranged in the first and the second arrangement direction, thereby printing at 600 dpi can be made in the main scanning direction and printing an image in high resolution can be made.

In the ink jet head 1, because of the structure that the plurality of the cavity 10 is arranged as a matrix, there need to consider of a crosstalk in order to achieve a printing result of a high quality that mispositioning of pixels (dots) cannot be recognized by human eyes. Herein, the term "crosstalk" is referred to as a phenomenon that, when a ink drop is discharged from one cavity 10 by activating (pressurizing) the cavity 10, the pressurizing force of the cavity 10 is transmitted to another cavity 10 that is adjacent to the activated cavity 10 and affects the discharging characteristics of the another cavity 10.

Incidentally, the crosstalk to be considered may be selected from among a few kinds of crosstalk such as an acoustical fluidic crosstalk. However, the present invention is focused to configure the angles and sizes of each of the constituent members of the ink jet head 1 so as to meet specific conditions, to thereby reduce a rigid crosstalk.

Figure 5A:
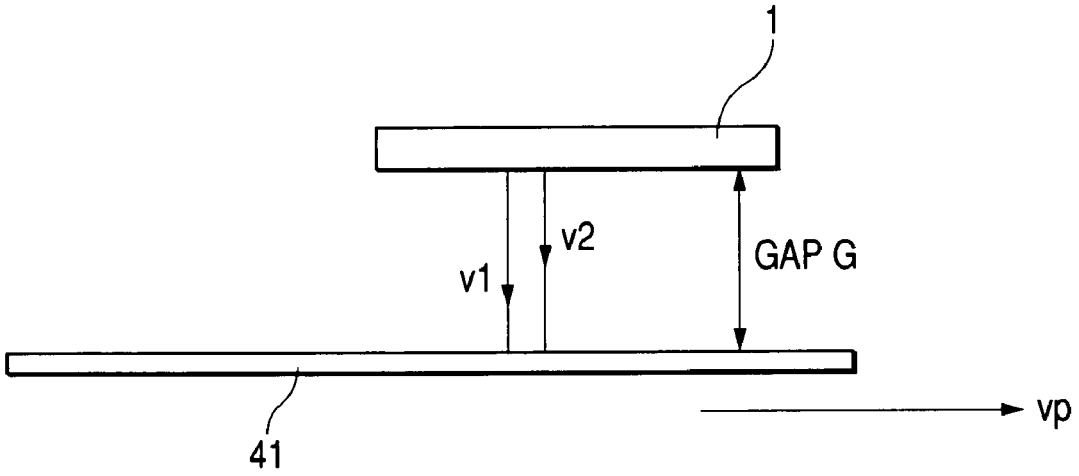
FIGS. 5A and 5B are explanatory views of an image-forming model of the ink jet head used for numerical analysis, FIG. 5A being a view showing a state in which ink drops are discharged at different velocities to a sheet of paper moving relative to the ink jet head, FIG. 5B being a view for explaining landing accuracy based on the difference between landing positions of the ink drops.
Figure 5B:
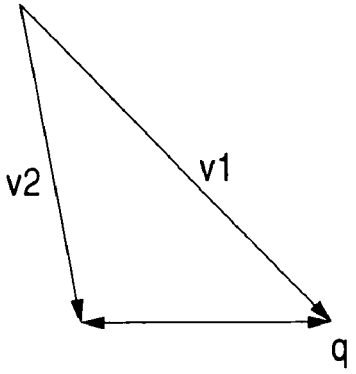
Figure 6A:
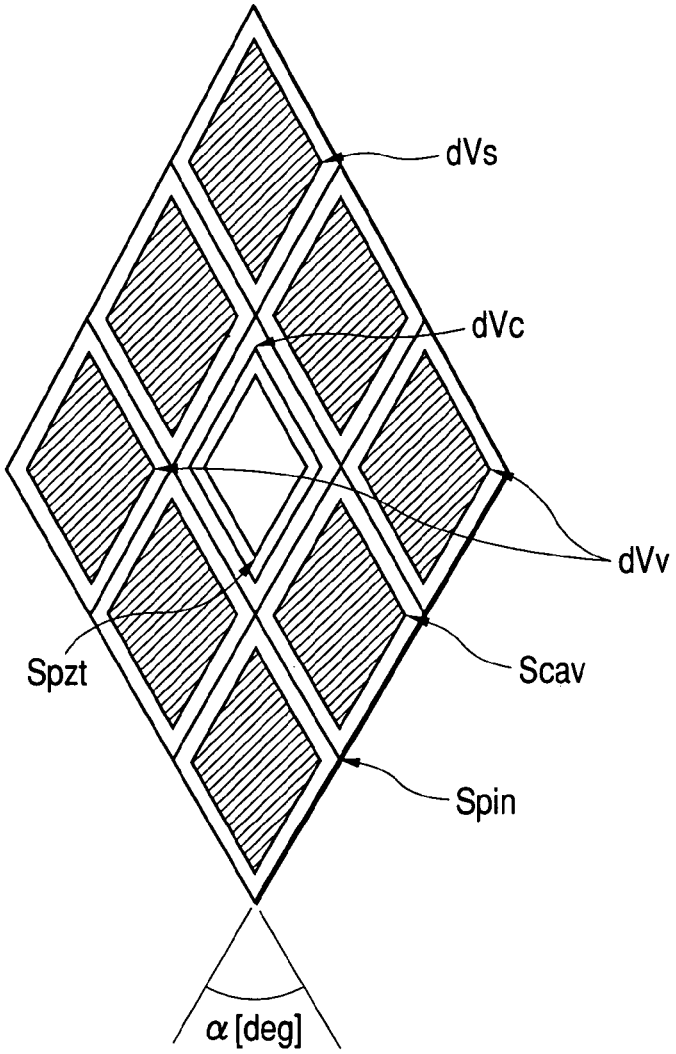
FIGS. 6A and 6B are explanatory views of a model of the ink jet head used for numerical analysis, FIG. 6A being a view showing a state of arrangement of a lattice of piezoelectric elements inclusive of cavities and the relations between relevant indices, FIG. 6B being a sectional view of the lattice.
Figure 6B:
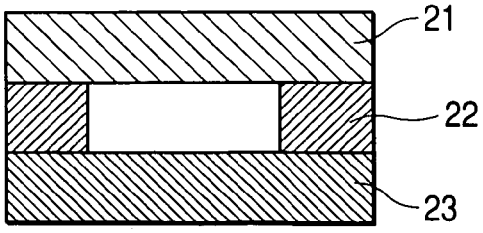

Hereinafter, a numerical analysis performed on a physical model as shown in FIGS. 5 and 6 for determining a preferable configuration of the angles and sizes for each of the constituent members of the ink jet head 1 will be described.

FIGS. 5A and 5B show a physical model for analyzing the printing by use of the ink jet head 1 onto a recording medium (sheet of paper). As shown in FIGS. 5A and 5B, it is assumed that the discharge velocity of an ink drop discharged from an objective ink discharge orifice 8 in the ink jet head 1 is v1, and the discharge velocity of an ink drop discharged from an ambient ink discharge orifice 8 near the objective ink discharge orifice 8 is v2.

In a case where the velocities of the two ink drops each discharged from the two ink discharge orifice 8 are equal (v1=v2), the relative positions between the positions of each of the two ink discharge orifices on the ink jet head 1 and the positions of each of the two ink drops discharged onto the sheet of paper 41 becomes equal. That is, in this case, each of the two ink drops discharged from each of the two ink discharge orifices are discharged on the sheet of paper 41 at a position where displaced from a discharge position when the sheet of paper 41 is set still at a distance corresponding to the transporting amount of the sheet of paper 41 within the time (arriving time) of arrival of the ink drop onto the sheet of paper 41.

However, in a case where the velocities of the two ink drops each discharged from the two ink discharge orifice 8 are not equal (v1≠v2), the ink drop having a smaller velocity needs extra time to reach the sheet of paper 41 than the ink drop having a larger velocity. Therefore, the sheet of paper 41 moves further for the extra time, and the ink drop having a smaller velocity is discharged on the sheet of paper 41 at a position where displaced from a regular position. As described above, in a case where each of the ink drops have different discharging velocity, the actual discharged position of each of the ink drops (the discharged position when the sheet of paper 41 is moving) will be displaced from the discharged position of each of the ink drops when the sheet of paper 41 is set still.

According to the fact described above, when the transporting velocity of a sheet of paper 41 is vp and the gap between the ink jet head 1 and the sheet of paper 41 is G, the arrival time difference Δt between the ink drops is given by the following expression.

$$\Delta t = G \cdot (1/v\mathbf{2} - 1/v\mathbf{1})$$

When the difference between landing positions of the ink drops discharged from the objective ink discharge orifice 8 and the ambient ink discharge orifice 8 respectively is regarded as landing accuracy q, the landing accuracy q is given as follows.

$$q \geqq \Delta t \cdot vp = G \cdot (1/v2 - 1/v1) \cdot vp = G \cdot vp / v1 \cdot (v1/v2 - 1)$$

This expression can be modified to a relational expression (A) as follows.

$$v2/v1 \geqq G \cdot vp / (q \cdot v1 + G \cdot vp) \quad (A)$$

Figure 7:
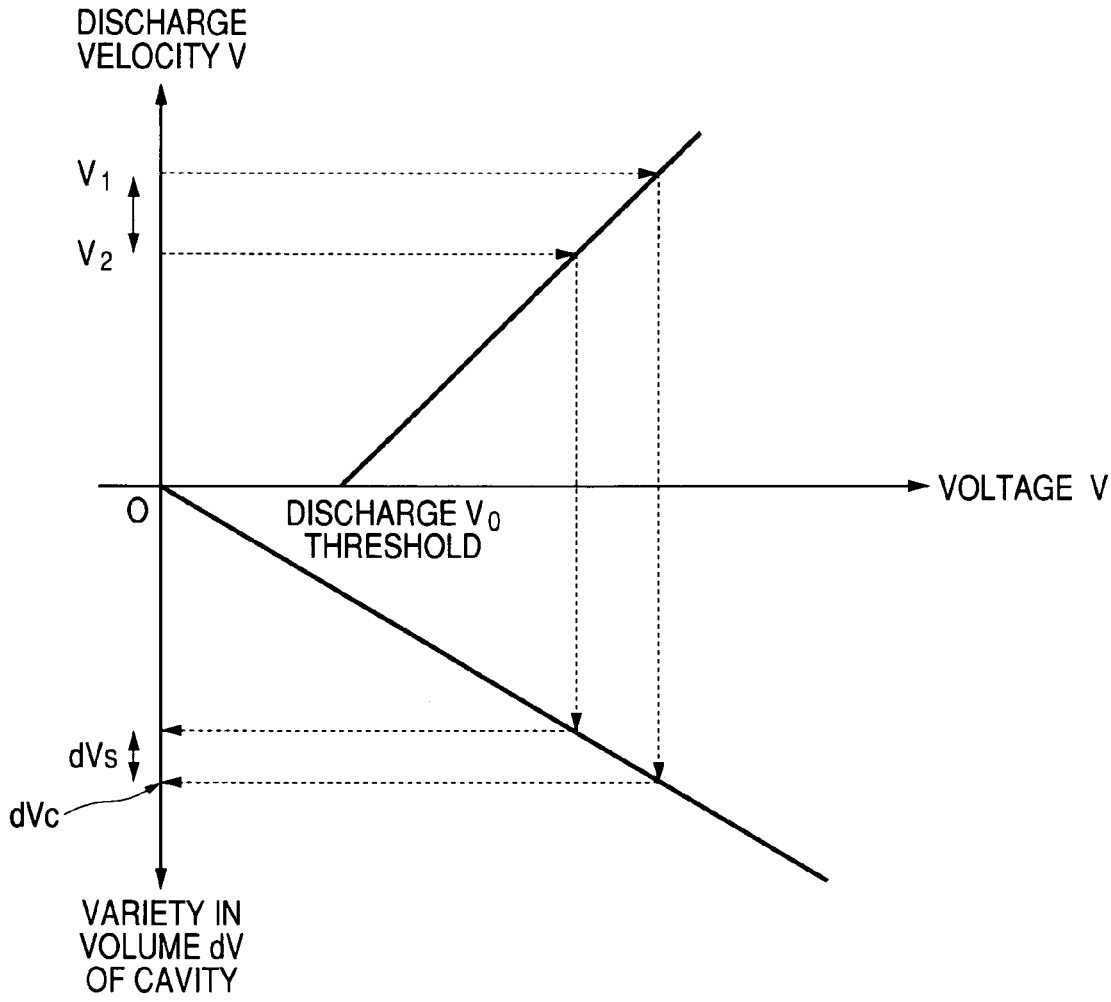
FIG. 7 is a graph showing the relations of discharge velocity and displacement of a piezoelectric element to a voltage applied to the piezoelectric element.

When dVc is the variety in volume of a piezoelectric element of the actuator unit 21 corresponding to the objective ink discharge orifice 8, and dVs is difference between the variety in volume of the piezoelectric element of the actuator unit 21 corresponding to the objective ink discharge orifice 8 and the variety in volume of the piezoelectric element of the ambient ink discharge orifice 8, relations between the variety in volume dVc and the difference between the variety in volumes are as shown in FIG. 7. Incidentally, in FIG. 7, the relations of the voltage V applied to a piezoelectric element in the actuator unit 21 to the velocity of ink discharged from a corresponding ink discharge orifice 8 and the variety in volume dV of the piezoelectric element (variety in volume of PZT) is also shown. Due to the fact that the voltage V and the variety in volume dV are nearly in proportion, from the relationship shown in FIG. 7, the following relational expression can be obtained.

$$v2/v1 = (dVc - dVs)/dVc = 1 - dVs/dVc$$

When the above relational expression is put into the expression (A), the expression (A) can be modified as follows.

$$dVs/dVc \leqq 1 - G \cdot vp / (q \cdot v1 + G \cdot vp) = q \cdot v1 / (q \cdot v1 + G \cdot vp)$$

Assume now that the paper transporting velocity vp=846.7 mm/s, G=1 mm and v1=9 m/s are selected, a result can be obtained from the above expression that if landing accuracy q needs to be suppressed to 5 $\mu$m, the ratio dVs/dVc is need to be configured as dVs/dVc≦5.0%, and if landing accuracy q needs to be suppressed to 10 $\mu$m, the ratio dVs/dVc is need to be configured as dVs/dVc≦9.6%. In another words, by suppressing the landing accuracy q within the range above, mispositioning of the discharged ink drops can be reduced to the amount that is unrecognizable by human eyes.

Incidentally, the ratio dVs/dVc is defined as crosstalk (ambient crosstalk) F0 received from the ambient cavities.

The cavities 10 in which arranged in the first arrangement direction that is orthogonal to the transporting direction of the sheet of paper, are tend to be activated to simultaneously discharge the ink drops. Therefore, when focused on one cavity 10, the crosstalk component from the ambient cavities adjacent to the focused cavity 10 in the first arrangement direction can be presumed larger than that from the ambient cavities adjacent to the focused cavity 10 in the other directions.

Therefore, herein, crosstalk (adjacent crosstalk) F0' received from adjacent cavities is defined as F0'=dVv/dVc. Incidentally, as shown in FIG. 6, the value dVv is a value of amount that relates to a variety in volume of the piezoelectric element corresponding to the cavity adjacent to the focused cavity 10 in the first arrangement direction. Herein, the value dVv is a value of amount (a difference of variety in volume) corresponds to a difference between the variety in volume of the piezoelectric element corresponding to the focused cavity 10 and the variety in volume of the piezoelectric element corresponding to the adjacent cavity.

Deformation efficiency F1 is defined by the following relational expression (B) when A is the number of active layers of the piezoelectric elements, Spin is the area [mm$^2$] occupied by one lattice, and Spzt is the area [mm$^2$] occupied by the active portions of the piezoelectric elements provided in accordance with one lattice in the matrix.

$$F1 = dVc / (Spzt \cdot A \cdot Spin) \quad (B)$$

Incidentally, the deformation efficiency F1 indicates the efficiency of deformation when the focused cavity 10 is taken as a single cavity. The term Spzt·A in the expression (B) is proportional to an electrostatic capacity. Therefore, the term Spzt·A is more valuable when the value thereof is less as proportional to the input electrical power. The term Spin that indicates the area occupied by one lattice is more valuable when the value thereof is less. The term dVc that indicates the variety in volume of the focused cavity 10 is more valuable when the value thereof is more. Therefore, the function F1 includes a term that is valuable when the value thereof is less in denominator and a term that is valuable when the value thereof is more in numerator, whereby it can be said that the function F1 is a function that is valuable when the value thereof is more. Furthermore, the deformation efficiency F1, as is apparent from the expression (B) as shown above, is a function indicating that what large variety in volume can be generated in a cavity by a small area and a small activating voltage (driving voltage).

Herein, further deformation efficiencies F2 and F3 are defined as the following relational expressions (C) and (D). The deformation efficiency F2 is a function that an effect of a total crosstalk from all the surrounding cavities adjacent to the focused cavity is added to the deformation efficiency F1. The deformation efficiency F3 is a function that an effect of a crosstalk from the cavities arranged on both sides of the focused cavity in a specific direction (in the first arrangement direction in the embodiment) is added to the deformation efficiency F1.

$$F2 = F1/dVs = dVc / (dVs \cdot Spzt \cdot A \cdot Spin) \quad (C)$$

$$F3 = F1/dVv = dVc / (dVv \cdot Spzt \cdot A \cdot Spin) \quad (D)$$

Figure 8A:
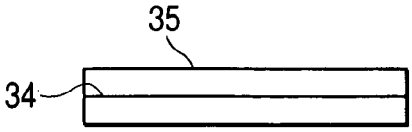
FIGS. 8A to 8H are sectional views showing examples of an actuator unit used for numerical analysis.
Figure 8B:
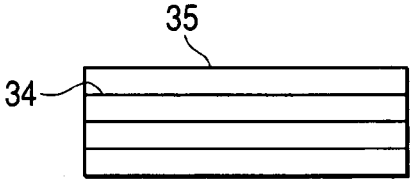
Figure 8C:
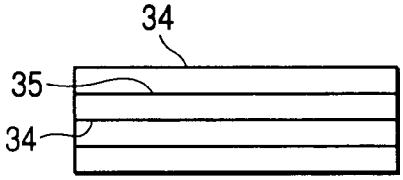
Figure 8D:
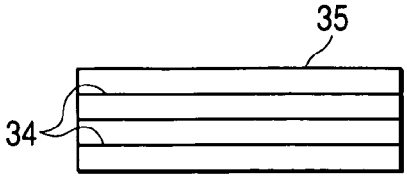
Figure 8E:
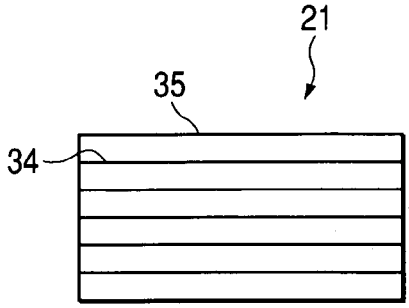
Figure 8F:
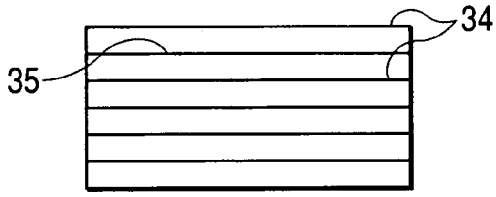
Figure 8G:
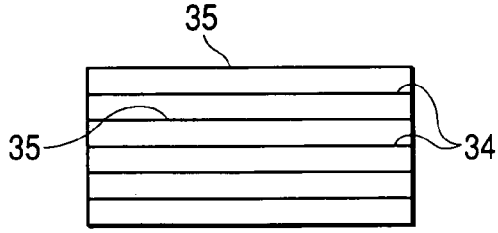
Figure 8H:
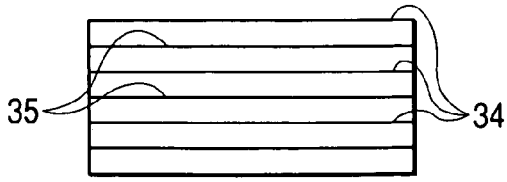

Incidentally, the number of active layers A means the number of layers which are contained in the piezoelectric layer forming the actuator unit 21 and each of which is put between a common electrode 34 connected to the ground and a drive electrode 35 (see FIGS. 8A to 8H). The number N of layers of the piezoelectric elements means the number of layers made of a piezoelectric material in the layered structure of the piezoelectric element. FIGS. 8A through 8H shows a layered structure of the piezoelectric element wherein: FIG. 8A shows a structure where N=2 and A=1; FIG. 8B shows a structure where N=4 and A=1; FIG. 8C shows a structure where N=4 and A=2; FIG. 8D shows a structure where N=4 and A=3; FIG. 8E shows a structure where N=6 and A=3; FIG. 8F shows a structure where N=6 and A=3; FIG. 8G shows a structure where N=6 and A=3; and FIG. 8H shows a structure where N=6 and A=4.

A trial of approximation is made by the following function (E) when $\alpha$ is an angle [°] which is one of internal angles of virtual lattices forming the matrix and which is not higher than 90°, and Scav is the area [mm$^2$] occupied by cavities contained in one lattice in the matrix. The shape of lattice projected onto the ink discharging surface is regarded as being similar to the cavity. Incidentally, the activating voltage (driving voltage) is set to be 20 V, the thickness of one piezoelectric element layer in the actuator unit 21 is set to be 15 μm, the thickness of the cavity plate 22 is set to be 50 μm, and the thickness of the base plate 23 is set to be 150 μm.

$$Fi=Ki\cdot N^{ai}\cdot A^{bi}\cdot \alpha^{ci}\cdot Spin^{di}\cdot (Scav/Spin)^{ei}\cdot (Spzt/Scav)^{fi} \quad (E)$$

Parameters ai through fi and Ki obtained as results of approximation according to i=0, 0', 1, 2 and 3 are shown as follows.

TABLE 1

| | A | b | C | d | e | f | K |
|---|---|---|---|---|---|---|---|
| 0 | 1.87686 | 0.31786 | −0.18649 | −1.09273 | 3.97019 | 0.93332 | 0.05307 |
| 0' | 1.55486 | 0.27907 | 1.03986 | −0.97015 | 4.24397 | 1.03880 | 0.00013 |
| 1 | −0.99131 | −0.46537 | 0.48121 | −0.31516 | 0.76705 | −0.78355 | 47.79013 |
| 2 | −1.87686 | −1.31786 | 0.18649 | −0.90727 | −4.97019 | −1.93332 | 18.84193 |
| 3 | −1.55486 | −1.27907 | −1.03986 | −1.02985 | −5.24397 | −2.03880 | 7620.4 |

Figure 9:
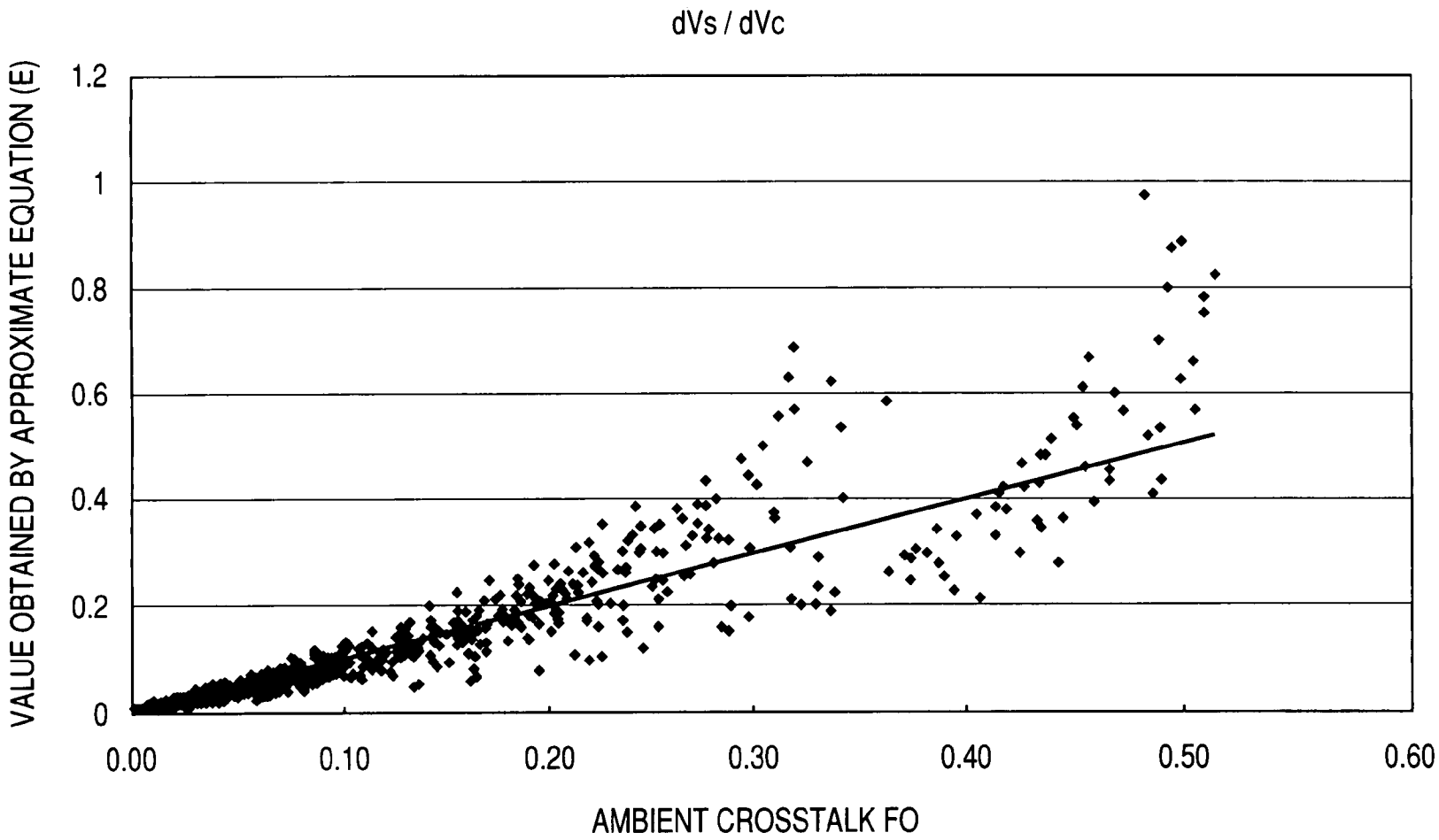
FIG. 9 is a graph showing the difference between an approximate value of ambient crosstalk calculated by approximation and an analytic value of ambient crosstalk.

Next, values of the ambient crosstalk F0=dVs/dVc and values of function (E) when i=0 are calculated for a plurality of cases wherein: the internal angle α of virtual lattice is changed to 30°, 60° and 90° successively; the area Spin occupied by one lattice is changed to 0.4, 0.6 and 0.8 (unit: $mm^2$) successively; Scav/Spin is changed to 0.4, 0.6 and 0.8 successively; Spzt/Scav is changed to 0.3, 0.6 and 0.9 successively; and the number N of layers of the piezoelectric elements and the number A of active layers are changed as shown in FIGS. 8A through 8H. The result obtained from the calculation is shown in FIG. 9. In FIG. 9, the relationship between the values of the ambient crosstalk F0 and the values obtained by the proximity function (E) for each of the cases are plotted. In FIG. 9, the solid line shows a line where the values obtained by the proximity function (E) equals to the values of the ambient crosstalk F0.

As apparent from FIG. 9, the proximity function (E) is well approximated to the ambient crosstalk F0 in a range where F0<0.10. Accordingly, in a case where the landing accuracy q need to be suppressed to 10 μm or smaller, the value calculated by the approximate expression (E) need to be reduced not larger than about 9.6%. Furthermore, in a case where the landing accuracy q need to be suppressed to 5 μm or smaller, the value calculated by the approximate expression (E) need to be reduced not larger than about 5.0%.

As described above, in the ink jet head 1, by configuring the angles and sizes for each of the constituent members so that the value of the approximate expression (E) when i=0 becomes not larger than 0.1, even in a case where the paper transporting velocity vp is set at high velocity such as vp=846.7 mm/s, suppressing of the effect of the crosstalk generated between the adjacent cavities can be achieved, to thereby obtain a printing result in high quality.

In addition, by configuring the angles and sizes for each of the constituent members so that the value of the approximate expression (E) (i.e. the value of the crosstalk) becomes not larger than 0.1, the ink jet heat 1 can achieve further advantages as described hereinafter.

The distance (pitch) of the adjacent pixels formed by two ink drops is approximately 42.3 μm when printing by the ink jet head 1 in resolution of 600 dpi (the resolution considered high quality nowadays). Therefore, if a displacement of +−20 μm occurs in the printed pixels, the weighted centers of the two pixels become overlapped. And if a displacement of +−10 μm, in which a half of the displacement when the weighted centers of the pixels overlaps, occurs, the displacement can be recognized by human eyes in sensitivity test.

According to the above, the ink jet head 1 is required to discharge the ink drops by ensuring the landing accuracy of approximately +−10 μm. In order to achieve the requirement, the ink jet head 1 needs to reduce the value of the crosstalk no larger than 0.1 in a case where the gap G is 1 mm and the paper transporting velocity vp is set at 846.7 mm/s. In other words, the ink jet head 1 can achieve printing in high quality that the displacement of the pixels cannot be recognized in high resolution of 600 dpi and in significantly high speed of 846.7 mm/s by configuring the angles and sizes for each of the constituent members so that the value of the crosstalk becomes not larger than 0.1.

Incidentally, in the ink jet head 1, when the angles and sizes for each of the constituent members are configured so that the value of the deformation efficiency F2, which is a value that an effect of a total crosstalk from all the surrounding cavities adjacent to the focused cavity is added to the deformation efficiency F1, becomes F2>800, the actuator unit 21 is deformed in high efficiency in accordance with input power regardless of the sequence of driving of the piezoelectric elements arranged as a matrix.

Therefore, in the ink jet head 1, by configuring the angles and sizes for each of the constituent members so that the value of the approximate expression (E) when i=2 exceeds the value of 800 (F2>800), large deformation in the cavity 10 can be obtained in spite of low power consumption. As a result, low power consumption in activating (driving) the actuator unit 21 can be achieved. In addition, the ink jet head 1 can achieve the printing in high quality in such that the landing accuracy of the ink drop is not larger than 10 μm and can prevent the increasing of the power consumption as a whole ink jet head 1. The above advantages also can be obtained even in a case where disposing more number of ink discharge orifices in both the main scanning direction and the secondary scanning direction, to thereby achieve more high-speed printing and achieve printing for larger sheet of papers.

In the ink jet head 1, when the angles and sizes for each of the constituent members are configured so that the value of the deformation efficiency F3, which is a value that an effect of a crosstalk from the cavities arranged on both sides of the focused cavity in the first arrangement direction is added to the deformation efficiency F1, becomes F3>7000, only crosstalk that affects the landing accuracy to be not larger than 10 μm occurs. Therefore, in the ink jet head 1, there is no need to enlarge the input power for overcoming the effect of the crosstalk (to enlarge the power need to compensate the effect of the crosstalk) in order to homogenize the printing quality. As a result, when focused on one cavity in a cavities aligned in the first arrangement direction (main scanning direction), the efficiency of use of the input power can be averaged at least for the cavities in the direction so that each of the actuator units 21 corresponding to all the cavities in the first arrangement direction deforms in high efficiency.

Therefore, in the ink jet head 1, by configuring the angles and sizes for each of the constituent members so that the value of the approximate expression (E) when i=3 exceeds the value of 7000 (F3>7000), large deformation in the cavity 10 can be obtained in spite of low power consumption.

Figure 10A:
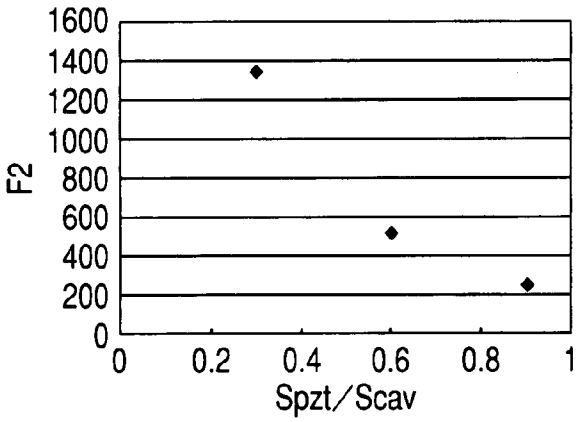
FIGS. 10A to 10D are graphs showing values of F2 and F3 when Spzt/Scav or A is changed.
Figure 10B:
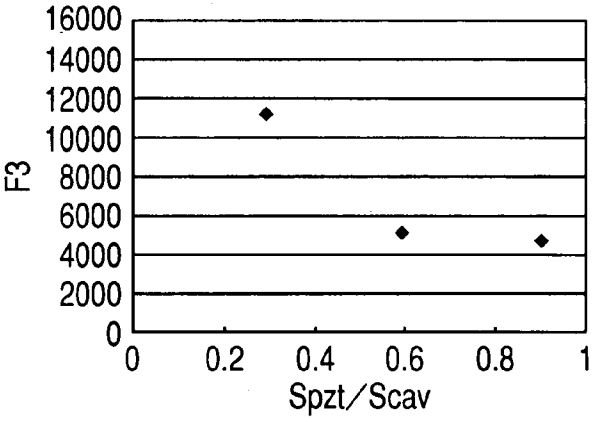

Next, a description will be made for the calculation of the values F2 and F3 using the approximate expression (E) by setting the parameter "i" as i=2 and 3 and changing the value of Spzt/Scav. The result of the calculation is shown in FIGS. 10A and 10B. As apparent from FIGS. 10A and 10B, by setting the area occupied by the active portions of the piezoelectric elements (Spzt) and the area occupied by cavities contained in one lattice in the matrix (Scav) so as to satisfy Spzt/Scav<0.5, the ink jet head 1 can achieve the satisfaction of both F2>800 and F3>7000. Incidentally, it has been found from further consideration that by configuring the values Spzt and Scav so as to satisfy Spzt/Scav<0.55, the values of F2 and F3 of the ink jet head 1 can be set at more desirable value.

In the above configuration, the area occupied by the active portions of the piezoelectric elements (Spzt) becomes almost half of the area occupied by cavities contained in one lattice in the matrix (Scav) so that an area for the electrodes for selectively driving the actuator element in each of the cavities can be reduced. Therefore, electronic insulation between the two adjacent electrodes can be easily obtained so that the short-circuiting between the electrodes can be assuredly prevented and arrange the cavities in more increased density.

Figure 10C:
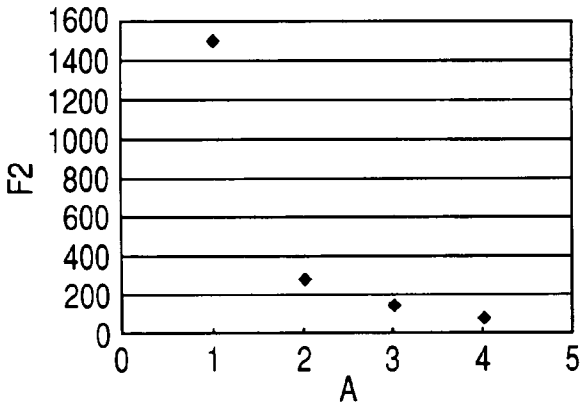
Figure 10D:
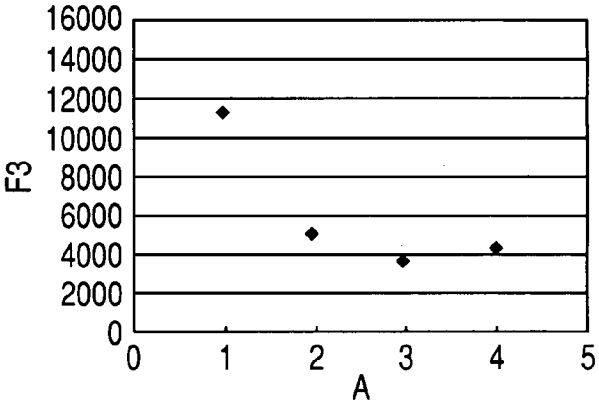

Next, a description will be made for the calculation of the values F2 and F3 using the approximate expression (E) by setting the parameter "i" as i=2 and 3 and changing the value of the number A of the active layers. The result of the calculation is shown in FIGS. 10C and 10D. As apparent from FIGS. 10C and 10D, by setting the number A of the active layers to "1" (A=1), the ink jet head 1 can achieve the satisfaction of both F2>800 and F3>7000. Therefore, it is preferable to configure the number A of the active layers for each of the cavities 10 in the ink jet head 1.

Furthermore, by configuring the number A of the active layers for each of the cavities 10 to be minimum, total area of the electrodes in the ink jet head 1 can be reduced. Therefore, amount of metal material (such as Au, Ag, or Pt) used in the ink jet head 1 in which could be a factor to raise the manufacturing cost of the actuator unit 21 can be reduced, to thereby lower the cost of the actuator unit 21.

Figure 11A:
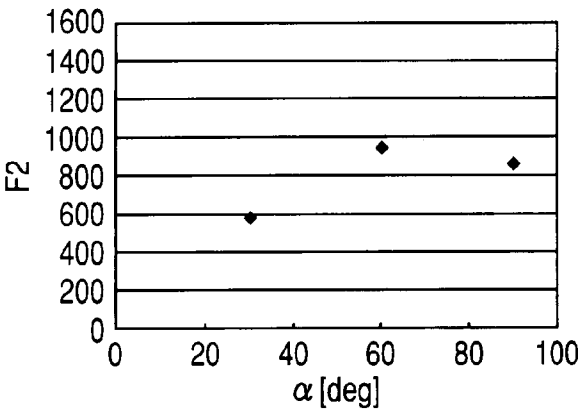
FIGS. 11A to 11D are graphs showing values of F2 and F3 when $\alpha$ or Scav/Spin is changed.
Figure 11B:
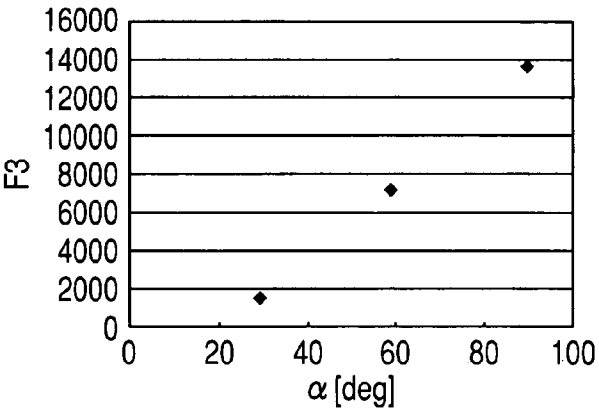

Next, a description will be made for the calculation of the values F2 and F3 using the approximate expression (E) by setting the parameter "i" as i=2 and 3 and changing the value of the internal angle $\alpha$ (unit: °) of virtual lattice to 30°, 60° and 90°. The result of the calculation is shown in FIGS. 11A and 11B. As apparent from FIGS. 11A and 11B, by setting the internal angle $\alpha$ of virtual lattice to be in the range of $60° < \alpha < 90°$, ink jet head 1 can achieve the satisfaction of both F2>800 and F3>7000. Therefore, it is preferable to set the internal angle $\alpha$ of virtual lattice to be in the range of $60° < \alpha < 90°$.

Particularly when the piezoelectric elements arranged as a matrix are driven regardless of the sequence of arrangement of the piezoelectric elements, variation in the value of F2 according to the angle $\alpha$ is so little that the ink jet head 1 having uniform discharge characteristic and high in efficiency and low in crosstalk can be obtained.

Figure 11C:
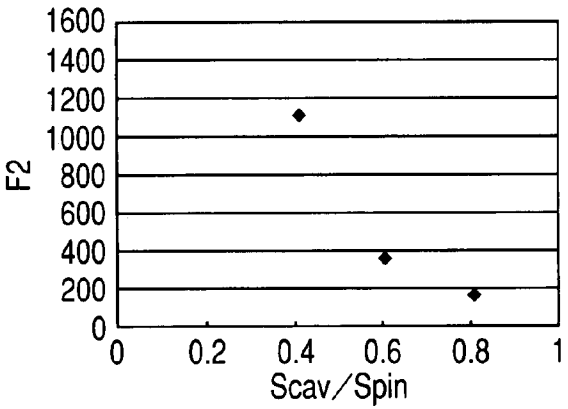
Figure 11D:
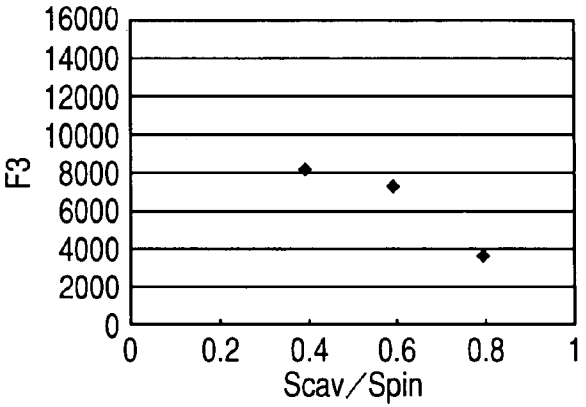

Next, a description will be made for the calculation of the values F2 and F3 using the approximate expression (E) by setting the value parameter "i" as i=2 and 3 and changing the value of Scav/Spin. The result of the calculation is shown in FIGS. 11C and 11D. As apparent from FIGS. 11C and 11D, by setting the area occupied by cavities contained in one lattice in the matrix (Scav) and the area occupied by one lattice (Spin) so as to satisfy Scav/Spin<0.5, the ink jet head 1 can achieve the satisfaction of both F2>800 and F3>7000. Therefore, it is preferable to configure the area occupied by cavities contained in one lattice in the matrix (Scav) and the area occupied by one lattice (Spin) so as to satisfy the relationship of Scav/Spin <0.5.

Incidentally, when assembling the ink jet head 1, the actuator unit 21 made of ceramics and the cavity plate 23 in which a plurality of cavities 10 are formed are joined together. In the joining, the actuator unit 21 and the cavity plate 23 are aligned and applied a certain amount of load. At this time, due to the face that the actuator unit 21 is relatively brittle, cracks and chips may occur in the actuator unit 21 by local concentration of the load and by a physical distortion. However, in the ink jet head 1, by setting the area occupied by cavities contained in one lattice in the matrix (Scav) and the area occupied by one lattice (Spin) so as to satisfy Scav/Spin<0.5, plentiful of joining area can be obtained for joining the actuator unit 21 and the cavity plate 23. Therefore, the actuator unit 21 and the cavity plate 23 can be joined with the occurrence of the cracks and chips being prevented and manufacturing yield of the ink jet head 1 can be improved.

Although the ink jet head 1 has been described above as an embodiment of the invention, the invention is not limited to the embodiment at all and various modifications may be made.

According to the ink jet recording head of the present invention, the angles and sizes of each of the constituent members are configured so as to meet a specific relational expression. As a result, crosstalk from ambient cavities can be reduced, to thereby obtain such good image quality that mispositioning of dots cannot be recognized by human eyes.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An ink jet recording head for discharging ink drop onto a recording medium, comprising:

a plurality of cavities configured to hold ink;

a plurality of piezoelectric elements disposed on the cavities respectively and configured to press each of the cavities; and a plurality of ink discharge orifices arranged on a ink discharging surface as a matrix and each connected to the cavities respectively, wherein the ink jet recording head is designed to satisfy the following relational expression:

$$K0 \cdot N^{a0} \cdot A^{b0} \cdot \alpha^{c0} \cdot Spin^{d0} \cdot (Scav/Spin)^{e0} \cdot (Spzt/Scav)^{f0} \leq 0.1$$

where a0=1.87686, b0=0.31786, c0=−0.18649, d0=−1.09273, e0=−3.97019, f0=0.93332 and K0=0.05307 are satisfied when N is a number of layers in one of the piezoelectric element, A is a number of active layers in one of the piezoelectric element, α is an angle [°] which is one of internal angles of virtual lattices containing one of the cavity and forming the matrix and which is not higher than 90°, Spin is an area [$mm^2$] occupied by one lattice in the matrix, Scav is an area [$mm^2$] occupied by the cavity contained in one lattice in the matrix, and Spzt is an area [$mm^2$] occupied by an active portion of the piezoelectric element provided in accordance with one lattice in the matrix.

2. The ink jet recording head as claimed in claim 1, wherein the ink jet recording head is designed to satisfy the following relational expression:

$$K2 \cdot N^{a2} \cdot A^{b2} \cdot \alpha^{c2} \cdot Spin^{d2} \cdot (Scav/Spin)^{e2} \cdot (Spzt/Scav)^{f2} > 800$$

where a2=−1.87686, b2=−1.31786, c2=0.18649, d2=−0.90727, e2=−4.97019, f2=−1.93332 and K2=18.84193 are satisfied.

3. The ink jet recording head as claimed in claim 1, wherein the angle α of the internal angle of the lattice is configured to satisfy 60°<α<90°.

4. The ink jet recording head as claimed in claim 1, wherein the area Spin occupied by the lattice and the area Scav occupied by the cavity contained in the lattice are configured to satisfy the following relational expression:

$$(Scav/Spin) < 0.5.$$

5. The ink jet recording head as claimed in claim 1, wherein the area Scav occupied by the cavity contained in the lattice and the area Spzt occupied by the active portion of the piezoelectric element are configured to satisfy the following relational expression:

$$(Spzt/Scav) < 0.55.$$

6. The ink jet recording head as claimed in claim 1, wherein the number A of active layers in one of the piezoelectric element is equal to 1.

7. An ink jet recording head for discharging ink drop onto a recording medium, comprising:

a plurality of cavities configured to hold ink;

a plurality of piezoelectric elements disposed on the cavities respectively and configured to press each of the cavities; and a plurality of ink discharge orifices arranged on a ink discharging surface as a matrix and each connected to the cavities respectively, wherein the ink jet recording head is designed to satisfy the following relational expression:

$$K0' \cdot N^{a0'} \cdot A^{b0'} \cdot \alpha^{c0'} \cdot Spin^{d0'} \cdot (Scav/Spin)^{e0'} \cdot (Spzt/Scav)^{f0'} \leqq 0.1$$

where a0'=1.55486, b0'=0.27907, c0'=1.03986, d0'=−0.97015, e0'=4.24397, f0'=1.03880 and K0'=0.00013 are satisfied when N is a number of layers in one of the piezoelectric element, A is a number of active layers in one of the piezoelectric element, α is an angle [°] which is one of internal angles of virtual lattices containing one of the cavity and forming the matrix and which is not higher than 90°, Spin is an area [$mm^2$] occupied by one lattice in the matrix, Scav is an area [$mm^2$] occupied by the cavity contained in one lattice in the matrix, and Spzt is an area [$mm^2$] occupied by an active portion of the piezoelectric element provided in accordance with one lattice in the matrix.

8. The ink jet recording head as claimed in claim 7, wherein the ink jet recording head is designed to satisfy the following relational expression:

$$K3 \cdot N^{a3} \cdot A^{b3} \cdot \alpha^{c3} \cdot Spin^{d3} \cdot (Scav/Spin)^{e3} \cdot (Spzt/Scav)^{f3} > 7000$$

where a3=−1.55486, b3=−1.27907, c3=−1.03986, d3=−1.02985, e3=−5.24397, f3=−2.03880 and K3=7620.4 are satisfied.

9. The ink jet recording head as claimed in claim 7, wherein the angle α of the internal angle of the lattice is configured to satisfy 60°<α<90°.

10. The ink jet recording head as claimed in claim 7, wherein the area Spin occupied by the lattice and the area Scav occupied by the cavity contained in the lattice are configured to satisfy the following relational expression:

$$(Scav/Spin) < 0.5.$$

11. The ink jet recording head as claimed in claim 7, wherein the area Scav occupied by the cavity contained in the lattice and the area Spzt occupied by the active portion of the piezoelectric element are configured to satisfy the following relational expression:

$$(Spzt/Scav) < 0.55.$$

12. The ink jet recording head as claimed in claim 7, wherein the number A of active layers in one of the piezoelectric element is equal to 1.

* * * * *